US006230592B1

(12) United States Patent
Hsiao

(10) Patent No.: US 6,230,592 B1
(45) Date of Patent: May 15, 2001

(54) TURNABLE TIGHTENING DEVICE ADAPTED TO TIGHTEN AND THEREBY FACILITATING SCREWING OF A SCREW HOOK INTO A WALL

(76) Inventor: Chieh-Jen Hsiao, 2F, No. 215, Yu-Te Road, Pei Dist., Taichung City (TW)

( * ) Notice: Subject to any disclaimer, the term of this patent is extended or adjusted under 35 U.S.C. 154(b) by 0 days.

(21) Appl. No.: 09/677,490

(22) Filed: Oct. 2, 2000

(51) Int. Cl.[7] ..... B25B 13/02
(52) U.S. Cl. ..... 81/125; 81/129; 81/901
(58) Field of Search ..... 81/125, 129, 146, 81/150, 151, 901

(56) References Cited

U.S. PATENT DOCUMENTS

| | | | | |
|---|---|---|---|---|
| 882,937 | * | 3/1908 | Fegley | 81/901 |
| 1,271,365 | * | 7/1918 | Reynolds, Jr. | 81/129 |
| 3,342,090 | * | 9/1967 | Martin | 81/129 |
| 4,689,881 | * | 9/1987 | Fall | 81/901 |
| 5,335,569 | * | 8/1994 | Rowley | 81/125 |
| 6,101,906 | * | 8/2000 | Tai | 81/129 |

* cited by examiner

*Primary Examiner*—James G. Smith
*Assistant Examiner*—Hadi Shakeri
(74) *Attorney, Agent, or Firm*—Brooks & Kushman P.C.

(57) ABSTRACT

A turnable tightening device includes a stationary member having a lower end portion adapted to be actuated by a driving tool to turn about an axis, and an upper end portion with a slot of a dimension adapted to permit only a joining member of a screw hook to have access thereto. A movable member is disposed on the stationary member and is movable relative to the upper end portion longitudinally, and has a retaining groove formed away from the upper end portion and adapted to retain a hook body of the screw hook. A biasing member is disposed for biasing the movable member away from the upper end portion such that a shoulder portion of the screw hook abuts tightly against an upper wall of the upper end portion, and such that the hook body of the screw hook engages tightly the movable member.

6 Claims, 7 Drawing Sheets

TURNABLE TIGHTENING DEVICE ADAPTED TO TIGHTEN AND THEREBY FACILITATING SCREWING OF A SCREW HOOK INTO A WALL

BACKGROUND OF THE INVENTION

1. Field of the Invention

This invention relates to a turnable tightening device, more particularly to a turnable tightening device adapted to tighten a screw hook and adapted to be actuated by a driving tool for screwing the screw hook into a wall.

2. Description of the Related Art

Referring to FIGS. 1 and 2, a conventional turnable holding device 1 adapted to hold a screw hook 2 and to be driven by a screw driver 3 for screwing the screw hook 2 into a wall, is shown to be in the form of a plate, and has a rectangular slot 101 formed in an upper end thereof for receiving a hook body 201 of the screw hook 2, and an actuating hole 102 formed in a lower end thereof such that an actuating end of the screw driver 3 can be inserted therein to turn the tightening device 1 and screw a threaded shaft 202 of the screw hook 2 into a wall. Since the hook body 201 of the screw hook 2 is movable in the slot 101, the threaded shaft 202 tends to deviate from the rotating axis of the screw driver 3 so as to affect adversely the screwing operation of the screw hook 2. In addition, the slot 101 of the fixed dimension cannot receive screw hooks of any size.

As shown in FIG. 3, another conventional turnable holding device has an upper forked end 301 which defines a V-shaped slot 302 adapted for accommodating screw hooks 2 of any size, and a lower hexagonal post end 303 adapted to engage a socket head of a screw driver 4. This type of holding device is still disadvantageous in that the hook body of the screw hook 2 may deviate from the rotating axis of the screw driver 4.

SUMMARY OF THE INVENTION

The object of the present invention is to provide a turnable tightening device which can position a screw hook thereto when being actuated by a driving tool for preventing deviation of the screw hook.

According to this invention, the turnable tightening device includes a stationary member, a movable member, and a biasing member. The stationary member has a lower end portion adapted to be actuated by a driving tool to turn about an axis, and an upper end portion disposed opposite to the lower end portion in a longitudinal direction which is parallel to the axis. The upper end portion includes a first upper wall, a first lower wall opposite to the first upper wall in the longitudinal direction, and a lateral wall extending in the longitudinal direction and joining the first upper wall with the first lower wall. The lateral wall is formed with a slot which extends in a transverse direction relative to the longitudinal direction and which is disposed to communicate the first upper and lower walls. The slot is adapted to permit only a joining member which is disposed between a hook body and a threaded shaft of a screw hook to have access thereto in the transverse direction. The movable member is disposed on the stationary member and is movable relative to the upper end portion in the longitudinal direction by guidance of a guiding member. The movable member includes a second upper wall which faces and which is spaced apart from the first lower wall in the longitudinal direction, and a second lower wall which is disposed opposite to the second upper wall in the longitudinal direction and which has a retaining groove of a profile adapted to retain the hook body of the screw hook. The biasing member is disposed for biasing the movable member away from the upper end portion such that a shoulder portion of the screw hook abuts tightly against the first upper wall and such that the hook body engages tightly the movable member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
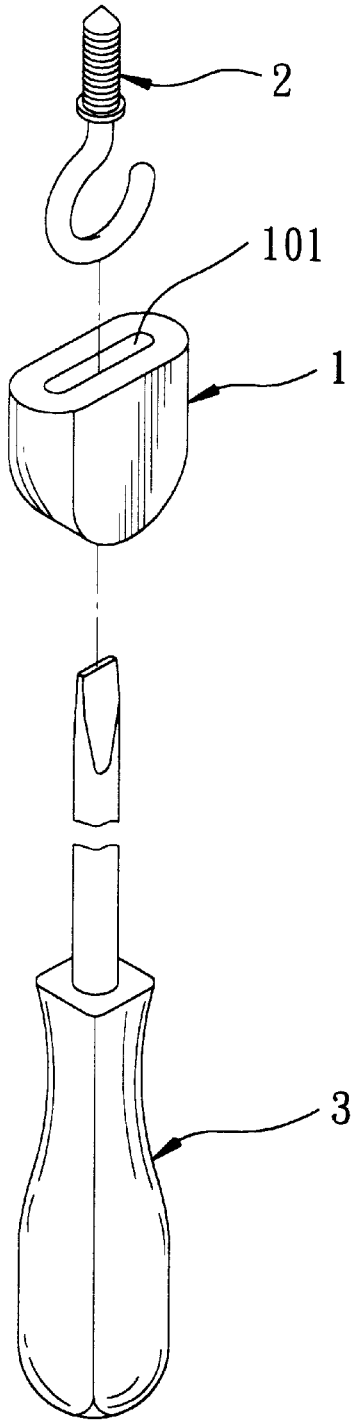
FIG. 1 PRIOR ART
FIG. 1 is an exploded perspective view of a conventional turnable tightening device.
Figure 2:
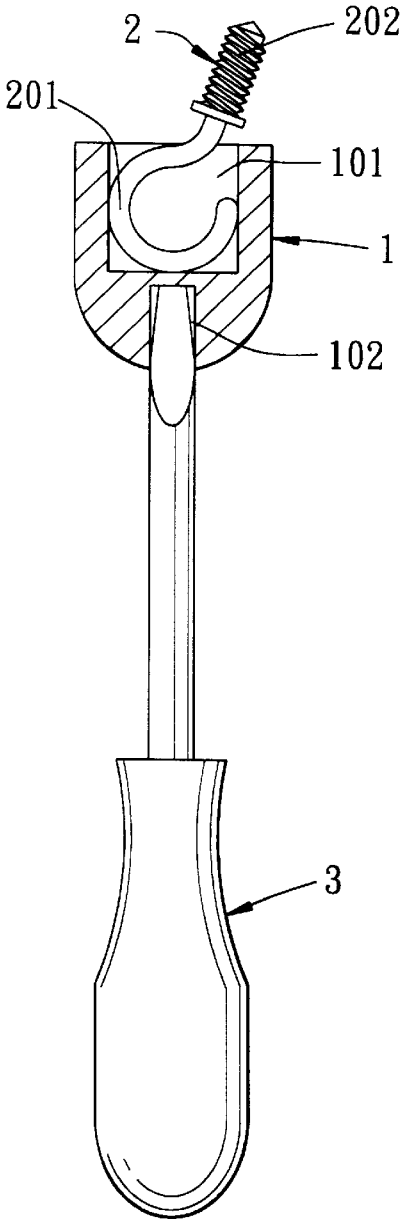
FIG. 2 PRIOR ART
FIG. 2 is a sectional view of the conventional tightening device in operation.
Figure 3:
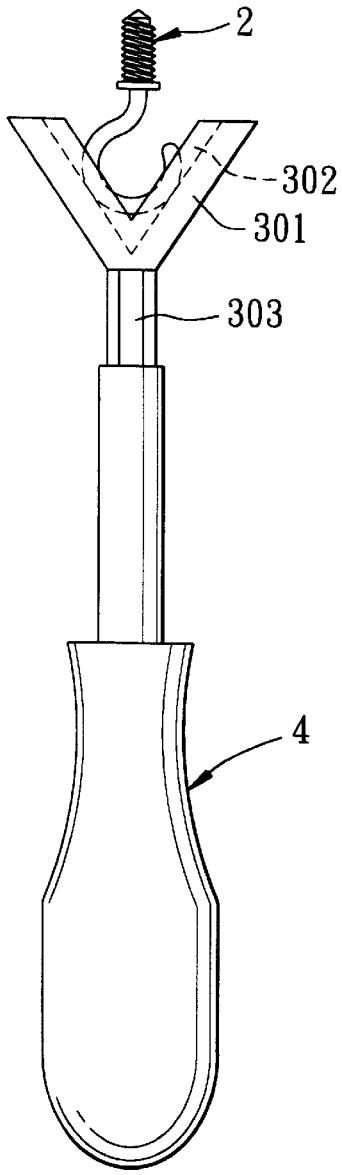
FIG. 3 PRIOR ART
FIG. 3 is a side view of another conventional turnable tightening device in operation.
Figure 4:
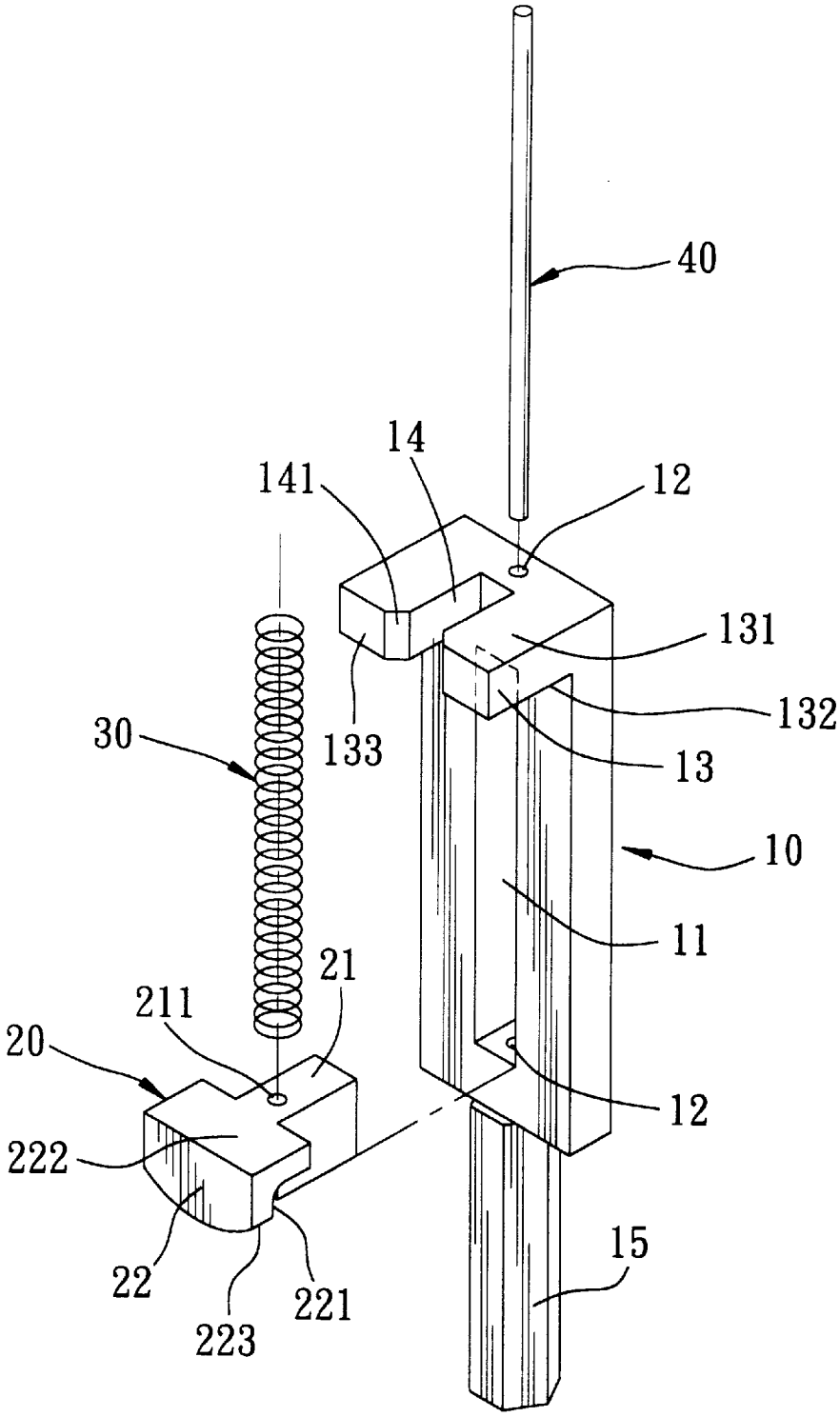
FIG. 4 is an exploded perspective view of a preferred embodiment of a turnable tightening device according to this invention.
Figure 5:
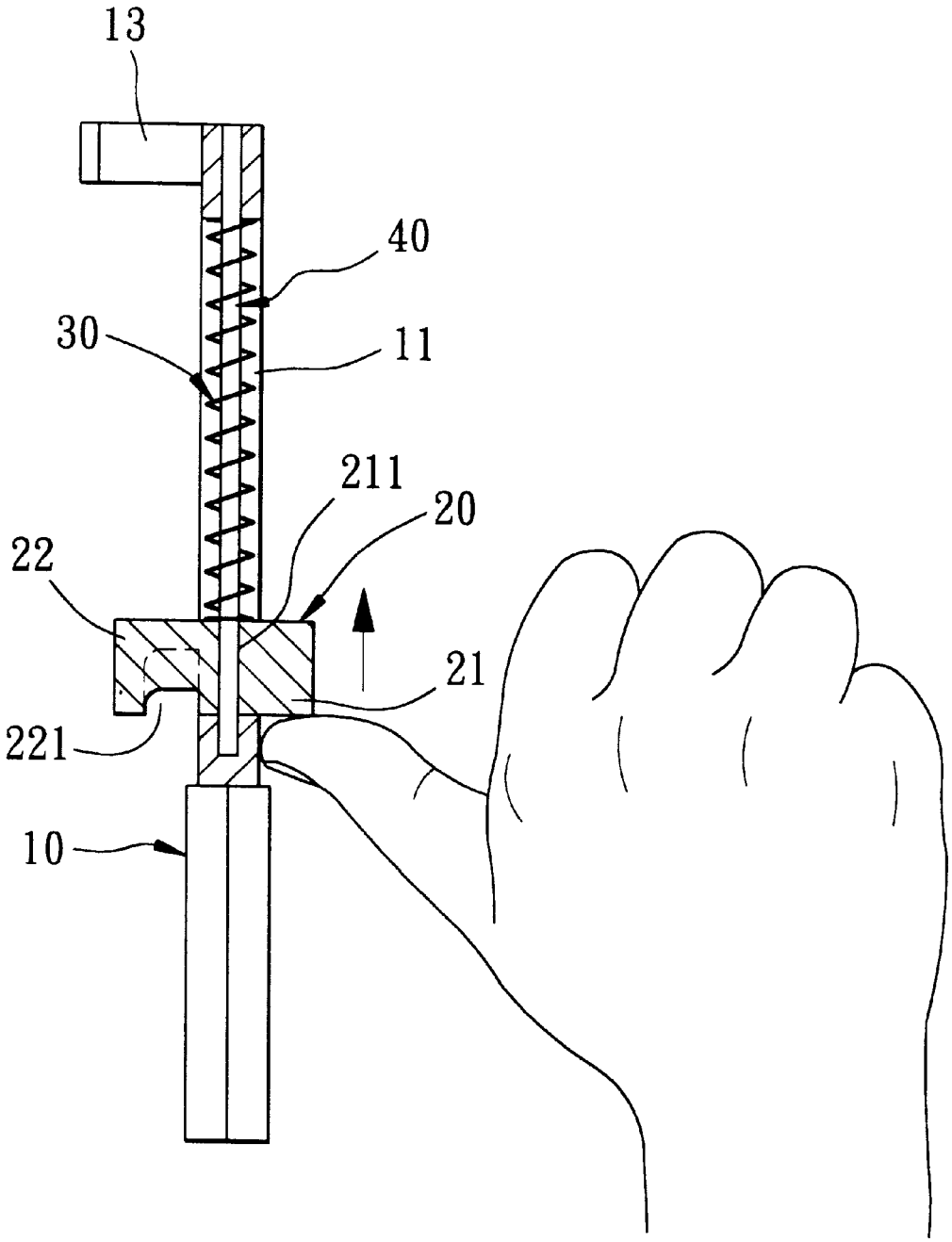
FIG. 5 is a sectional view of the preferred embodiment.
Figure 6:
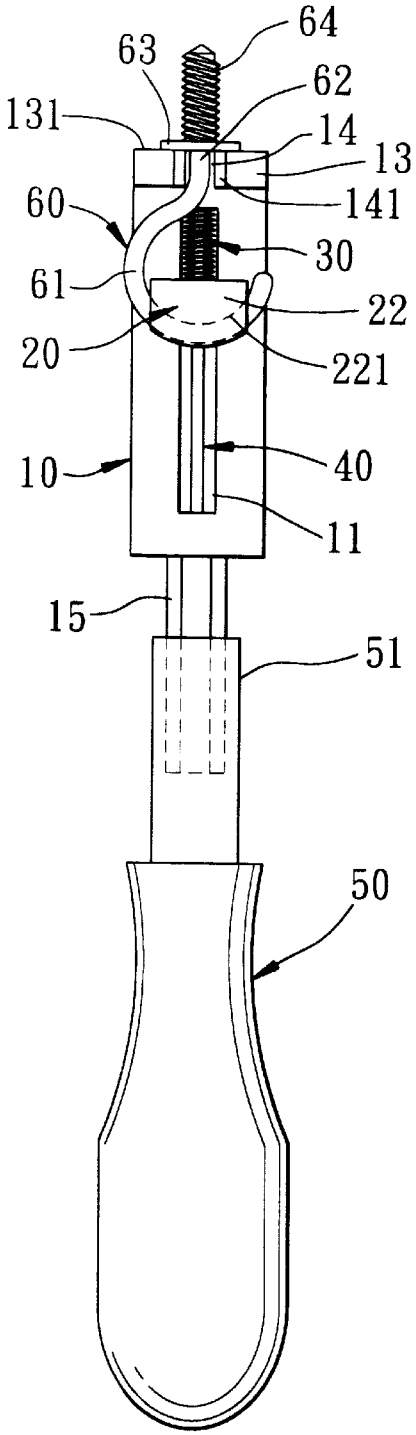
FIG. 6 is a schematic view showing the preferred embodiment when used to tighten a screw hook of a smaller hook body.

Referring to FIGS. 4, 5 and 6, the preferred embodiment of the turnable tightening device according to the present invention is shown to comprise an elongated stationary member 10, a movable member 20, and a biasing member 30.

The stationary member 10 has a lower end portion 15, and an upper end portion 13 which is disposed opposite to the lower end portion 15 in a longitudinal direction. In this embodiment, the lower end portion 15 is in the form of a hexagonal post that is adapted to engage an actuating end 51 of a driving tool 50, such as a socket head of a screw driver, so as to be capable of being actuated to turn about an axis parallel to the longitudinal direction. The upper end portion 13 includes a first upper wall 131, a first lower wall 132 opposite to the first upper wall 131 in the longitudinal direction, and a lateral wall 133 which extends in the longitudinal direction and which joins the first upper wall 131 with the first lower wall 132. The lateral wall 133 is formed with a slot 14 which extends in a transverse direction relative to the longitudinal direction and which is disposed to communicate the first upper and lower walls 131,132. The slot 14 is of a dimension so as to permit only a joining member 62, which is disposed between a hook body 61 and a threaded shaft 64 of a screw hook 60, to access thereto in the transverse direction, as shown in FIG. 6. The slot 14 has proximate and distal ends relative to the lateral wall 133 and opposite to each other in the transverse direction. In this embodiment, the proximate end has a width which is larger than that of the distal end. Particularly, two guiding wall surfaces 141 are formed at the proximate end and diverge towards the lateral wall 133 so as to facilitate entry of the joining member 62 of the screw hook 60 into the slot 14. An elongated guiding groove 11 is formed in the stationary member 10 between the upper and lower end portions 13,15, and extends in the longitudinal direction. A guiding shaft 40 passes through the guiding groove 11 and two secured holes 12 which are respectively formed in the upper and lower end portions 13,15, and extends in the longitudinal direction.

The movable member 20 includes a sliding block 21 and a retaining block 22 which extends from the sliding block 21 in a transverse direction relative to the longitudinal direction. The sliding block 21 engages slidably the guiding groove 11 so as to cooperate with the guiding groove 11 to serve as a guiding member for regulating the movement of the movable member 20 relative to the upper end portion 13 of the stationary member 10 in the longitudinal direction. A through hole 211 is formed through the sliding block 21 for slidable passage of the guiding shaft 40. The retaining block 22 includes a second upper wall 222 which faces and which is spaced apart from the first lower wall 132 of the upper end portion 13 in the longitudinal direction, and a second lower wall 223 which is disposed opposite to the second upper wall 222 in the longitudinal direction and which has a retaining groove 221 of a profile that is adapted to retain a part of the hook body 61 of the screw hook 60.

The biasing member 30, such as a compression spring 30, is mounted in the guiding groove 11 and around the guiding shaft 40, and has two ends which abut against an upper wall of the guiding groove 11 and the sliding block 21, respectively, for biasing the movable member 20 away from the upper end portion 13 of the stationary member 10.

In use, as shown in FIGS. 5 and 6, a pressing force is first applied on the movable member 20 to move the latter towards the upper end portion 13 of the stationary member 10 against the biasing force of the compression spring 30. Then, the hook body 61 of the screw hook 60 is retained in the retaining groove 221, and the threaded shaft 64 and a shoulder portion 63 of the screw hook 60 extend outwardly of the upper end portion 13 through the slot 14. Subsequently, the movable member 20 is released to move away from the upper end portion 13 by virtue of the biasing force of the compression spring 30 with the guidance of the guiding member so that the shoulder portion 63 of the screw hook 60 abuts tightly against the first upper wall 131 of the upper end portion 13, and so that the hook body 61 engages tightly the movable member 20.

Figure 7:
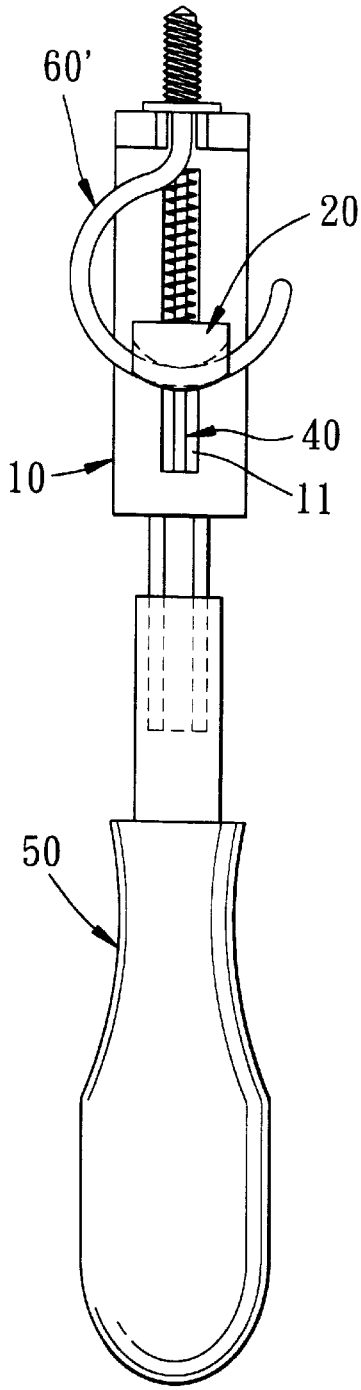
FIG. 7 is a schematic view showing the preferred embodiment when used to tighten a screw hook with a larger hook body.
Figure 8:
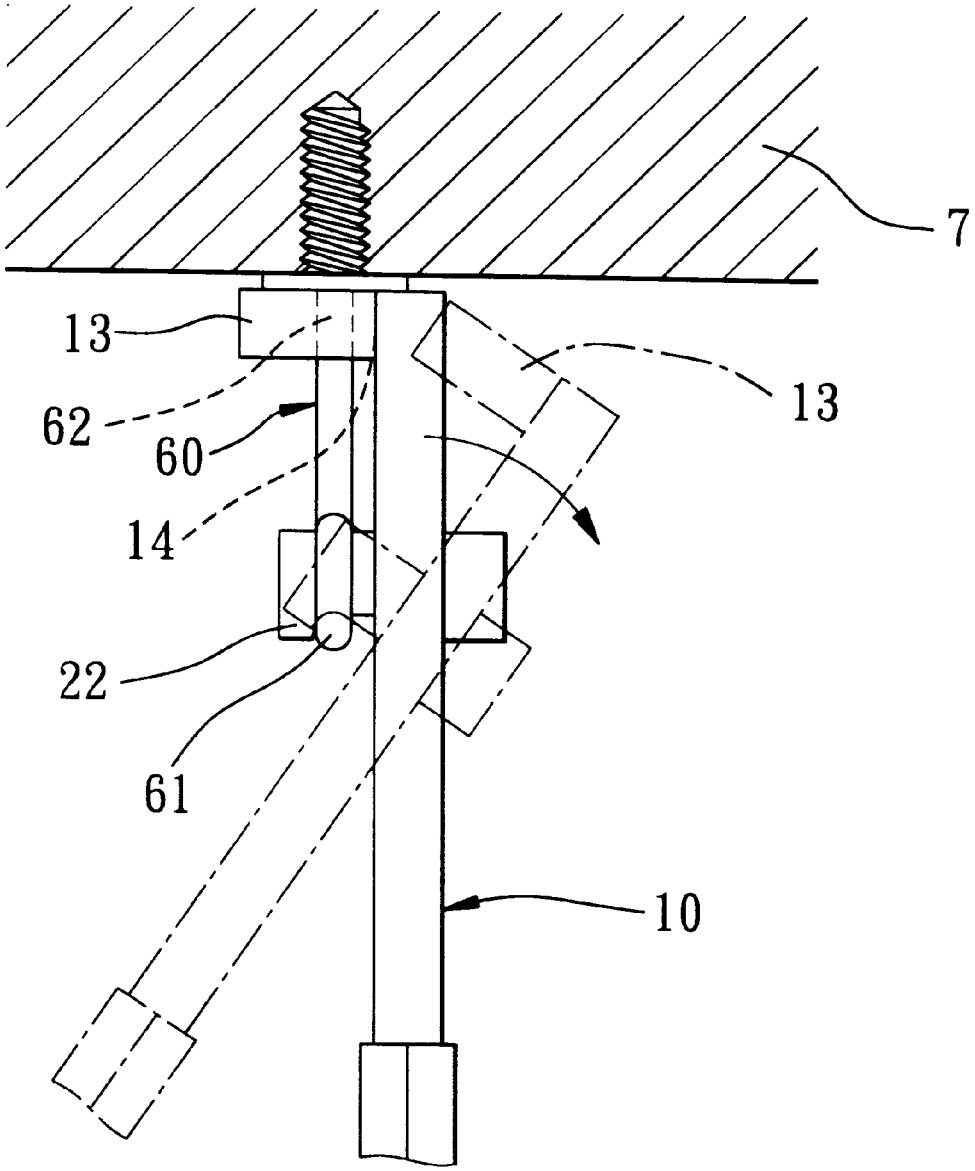
FIG. 8 is a schematic view showing how the preferred embodiment is released from a screw hook after the screw hook has been screwed into a wall.

The actuating end 51 of the driving tool 50 can be sleeved on the lower end portion 15 of the stationary member 10 to turn the latter about the axis so as to screw the screw hook 60 into a wall 7 (as shown in FIG. 8). As shown in FIGS. 6 and 7, in view of the construction as such, the turnable tightening device according to this invention is suitable for tightening screw hooks 60,60' of any size.

Referring to FIG. 8, when the screw hook 60 has been screwed into a wall 7, the stationary member 10 can be slightly rotated about the hook body 61 of the screw hook 60 to detach the joining member 62 from the slot 14. Then, the hook body 61 is detached from the retaining groove 61 by a slight upward movement of the stationary member 10, thereby detaching the turnable tightening device from the screw hook 60.

Figure 9:
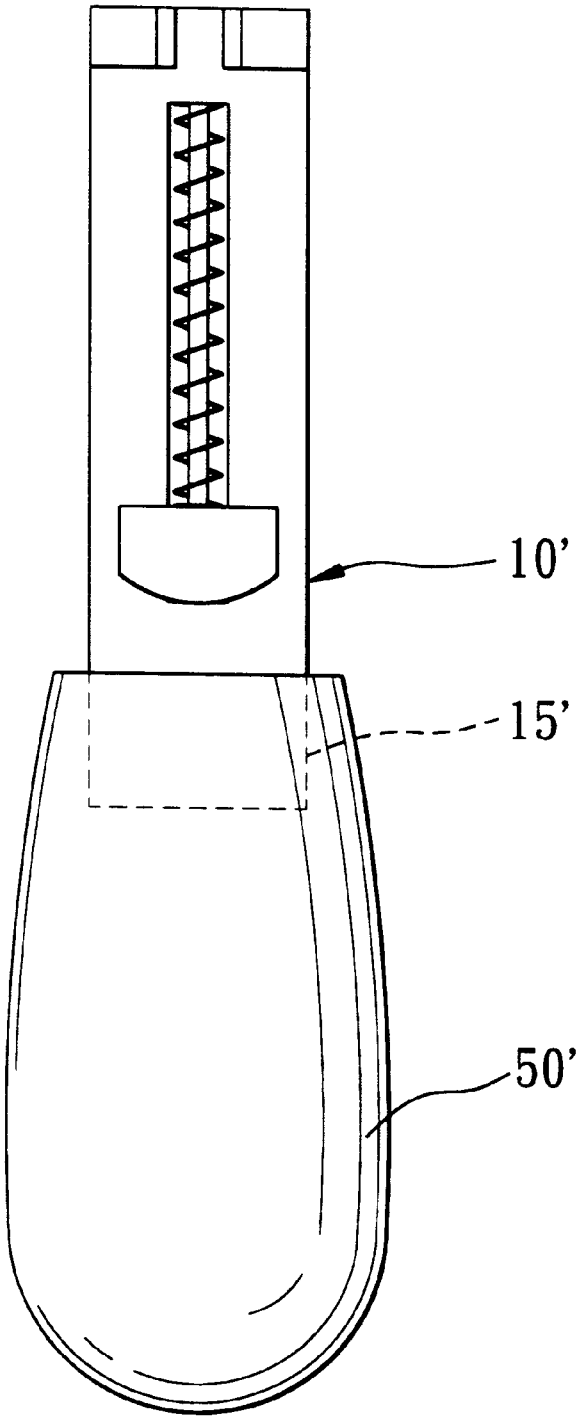
FIG. 9 is a schematic view of another preferred embodiment according to this invention.

Referring to FIG. 9, another preferred embodiment of the turnable tightening device according to this invention is shown to be similar to the previous embodiment, except that the lower end portion 15' of the stationary member 10' is secured to the driving tool 50', which is in the form of a handle.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A turnable tightening device adapted to tighten a screw hook, and adapted to be actuated by a driving tool which includes a handle and a shank with an actuating end, for screwing the screw hook into a wall, the screw hook including a hook body, a threaded shaft, and a joining member interposed between the hook body and the threaded shaft and forming a shoulder portion with the hook body, said turnable tightening device comprising:

a stationary member having a lower end portion adapted to be actuated by the driving tool to turn about an axis, and an upper end portion disposed opposite to said lower end portion in a longitudinal direction which is parallel to the axis, said upper end portion including a first upper wall, a first lower wall opposite to said first upper wall in the longitudinal direction, and a lateral wall extending in the longitudinal direction and joining said first upper wall with said first lower wall, said lateral wall being formed with a slot that extends in a transverse direction relative to the longitudinal direction and that is disposed to communicate said first upper and lower walls, said slot having a dimension adapted to permit only the joining member of the screw hook to have access thereto in the transverse direction;

a movable member disposed on said stationary member and movable relative to said upper end portion in the longitudinal direction, said movable member including a second upper wall facing and spaced apart from said first lower wall in the longitudinal direction, and a second lower wall disposed opposite to said second upper wall in the longitudinal direction and having a retaining groove of a profile adapted to retain the hook body of the screw hook;

a guiding member disposed to regulate movement of said movable member relative to said upper end portion in the longitudinal direction; and a biasing member for biasing said movable member away from said upper end portion such that the shoulder portion of the screw hook abuts tightly against said first upper wall and such that the hook body of the screw hook engages tightly said movable member.

2. The turnable tightening device as claimed in claim 1, wherein said guiding member includes a guiding groove formed in said stationary member between said upper and lower end portions and extending in the longitudinal direction, and a sliding block extending from said movable member in the transverse direction and away from said retaining groove and disposed slidably in said guiding groove.

3. The turnable tightening device as claimed in claim 2, wherein said biasing member is a compression spring mounted in said guiding groove and having two ends abutting against said upper end portion and said sliding block, respectively.

4. The turnable tightening device as claimed in claim 3, wherein said guiding member further includes a guiding shaft mounted in said guiding groove, extending in the longitudinal direction, and slidably extending through said sliding block such that said sliding block is slidable along said guiding shaft, and wherein said compression spring surrounds said guiding shaft.

5. The turnable tightening device as claimed in claim 1, wherein said slot has proximate and distal ends relative to said lateral wall and opposite to each other in the transverse direction, said proximate end having a width which is larger than that of said distal end so as to facilitate entry of the joining member of the screw hook into said slot.

6. The turnable tightening device as claimed in claim 1, wherein said lower end portion of said stationary member is formed as a hexagonal post that is adapted to engage the actuating end of the driving tool.

* * * * *